United States Patent [19]

Karino et al.

[11] 4,267,262

[45] May 12, 1981

[54] COLOR DIFFUSION TRANSFER PHOTOGRAPHIC ELEMENTS COMPRISING A NEUTRALIZING SYSTEM TIMING LAYER

[75] Inventors: Yukio Karino; Shinji Sakaguchi; Yoshio Sakakibara, all of Minami-ashigara, Japan

[73] Assignee: Fuji Photo Film Co., Ltd., Minami-ashigara, Japan

[21] Appl. No.: 26,510

[22] Filed: Apr. 3, 1979

[30] Foreign Application Priority Data

Apr. 3, 1978 [JP] Japan ..... 53-38932

[51] Int. Cl.[3] ..... G03C 1/40; G03C 1/48; G03C 1/76; G03C 5/38

[52] U.S. Cl. ..... 430/463; 430/215; 430/497; 430/536; 428/515; 428/520; 428/522; 428/532

[58] Field of Search ..... 96/119 R, 77, 76 R; 428/515, 522, 520, 532; 430/215, 463, 497, 644, 536

[56] References Cited

U.S. PATENT DOCUMENTS 4,029,849 6/1977 Abel ..... 96/77

OTHER PUBLICATIONS

"Neutralizing Materials. . . 38 , *Research Disclosure* No. 12331, 7/1974, pp. 22–24.

*Primary Examiner*—Richard C. Schilling

*Attorney, Agent, or Firm*—Sughrue, Rothwell, Mion, Zinn and Macpeak

[57] ABSTRACT

In a photographic element for the color diffusion transfer process having a neutralizing system comprising a neutralizing layer and a timing layer, the improvement which comprises said timing layer containing a mixture of acetyl cellulose and a polymer represented by the general formula (I):

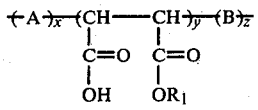

(I)

wherein A represents a repeating unit represented by the general formula (II):

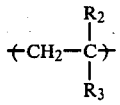

(II)

wherein $R_2$ represents a hydrogen atom, a halogen atom, or a methyl group; $R_3$ represents a hydrogen atom, a halogen atom, an alkyl group, an aryl group, a $-(CH_2)_a O-R_4$ group, a $-(CH_2)_a O-C(=O)-R_5$ group, or a $-C(=O)-O-R_6$ group;

$R_4$ represents an alkyl group or an aralkyl group; $R_5$ and $R_6$, which may be the same or different, each represents an alkyl group, an aryl group, or an aralkyl group; and a represents 0 or 1; $R_1$ represents an alkyl group, an aryl group or an aralkyl group; B represents a repeating unit derived from an ethylene-type monomer different than A excluding the monomer component having the formula

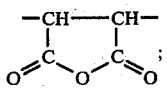

x is about 20 to 90 mol %; y is about 10 to 80 mol %; and z is about 0 to 30 mol %.

21 Claims, No Drawings

COLOR DIFFUSION TRANSFER PHOTOGRAPHIC ELEMENTS COMPRISING A NEUTRALIZING SYSTEM TIMING LAYER

BACKGROUND OF THE INVENTION

1. Field of the Invention

This invention relates to the color diffusion transfer photographic process, and more particularly, to a novel neutralizing system for use in color diffusion transfer photographic elements.

2. Description of the Prior Art

It is well known that a neutralizing layer is used for arresting development and stabilization of images in photosensitive materials for the color diffusion transfer process. Furthermore, it is well known to form a neutralizing system to prevent too fast a neutralization by combining a neutralizing layer and various timing layers as illustrated in *Research Disclosure,* No. 12331 (No. 123, July, 1974). In particular, U.S. Pat. No. 3,753,764 describes the use of acetyl cellulose in such a timing layer. However, it is pointed out in U.S. Pat. No. 4,029,849 that the use of acetyl cellulose in a timing layer is accompanied by such difficulties as the storage stability at high temperature and high humidity is reduced, the acetyl cellulose is difficult to hydrolyze with alkali to prolong the neutralization time period, and the maximum and minimum transferred optical densities increase. U.S. Pat. No. 4,029,849 describes the use of a maleic anhydride copolymers together with acetyl cellulose for overcoming these difficulties, however, even if acetyl cellulose is used together with styrene-maleic anhydride copolymer, which is described in U.S. Pat. No. 4,029,849, the storage stability is still insufficient and hence further improvement is desired. Still, because a maleic anhydride copolymer has insufficient compatibility with acetyl cellulose, the stability of the coating composition containing such a copolymer is low and the transparency of the coated layer is poor.

U.S. Pat. No. 4,029,849 discloses mixing acetyl cellulose with copolymer containing a maleic acid monomethyl ester comonomer but the copolymer contains maleic anhydride which makes the copolymer essentially different than the copolymer of this invention, the essential feature of which is that it does not contain maleic anhydride and contains 10 to 80 mol% of a half ester of maleic acid as the comonomer component.

If the transparency of a timing layer is not good in a film unit wherein a light-sensitive element is exposed through the timing layer, the sensitivity and resolving power of the unit is low.

SUMMARY OF THE INVENTION

A principal object of this invention therefore is to provide a photographic element for the color diffusion transfer photographic process capable of providing color images having improved image quality.

Another object of this invention is to provide a photographic element for the color diffusion transfer photographic process having improved storage stability.

Still a further object of this invention is to provide a photographic element for the color diffusion transfer photographic process having a highly transparent neutralizing system.

As a result of various investigations, it has been discovered that the above-mentioned objects can be effectively attained using a copolymer represented by the formula (I) together with acetyl cellulose in at least one of the timing layers in a photographic element for the color diffusion transfer photographic process having a neutralizing system for reducing the pH of an alkaline processing composition, wherein the neutralizing system includes a neutralizing layer and a timing layer or layers and the timing layer or layers are disposed directly or indirectly on or under the neutralizing layer such that the alkaline processing composition reaches the neutralizing layer through the timing layer or layers. The photographic element may further include a support, a photosensitive element comprising at least one silver halide emulsion layer having a dye image providing material associated therewith, an image-receiving element capable of fixing the diffusible dye or dyes formed from the dye image providing material or materials to form a color image therein, optionally another hydrophilic colloid layer or layers, and an alkaline processing composition capable of developing the exposed photosensitive element.

DETAILED DESCRIPTION OF THE INVENTION

In general formula (I):

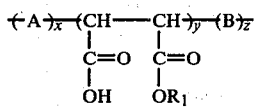

(I)

A represents a repeating unit represented by the general formula (II):

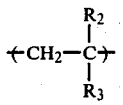

(II)

wherein $R_2$ represents a hydrogen atom, a halogen atom, or a methyl group; $R_3$ represents a hydrogen atom, a halogen atom, a straight chain alkyl group preferably having 1 to 12 carbon atoms (such as a methyl group, an ethyl group, a butyl group, an octyl group, an undecyl group, a lauryl group, etc.), a monocyclic aryl group preferably having 6 to 12 carbon atoms (such as a phenyl group, etc.), a $-(CH_2)_a O-R_4$ group, a $-(CH_2)_a O-\underset{\underset{O}{\|}}{C}-R_5$ group, or a $-\underset{\underset{O}{\|}}{C}-O-R_6$ group;

$R_4$ represents a straight or branched chain alkyl group preferably having 1 to 12 carbon atoms (such as a methyl group, an ethyl group, a butyl group, a propyl group, an isobutyl group, a hexyl group, an octyl group, a 2-ethylbutyl group, etc.), a monocyclic aralkyl group preferably having 7 to 12 carbon atoms (such as a benzyl group, etc.); $R_5$ and $R_6$, which may be the same or different, each represents a straight or branched chain alkyl group preferably having 1 to 8 carbon atoms (such as a methyl group, an ethyl group, a propyl group, a tert-butyl group, an octyl group, etc.), a monocyclic aryl group preferably having 6 to 12 carbon atoms (such as a phenyl group, etc.), an aralkyl group preferably having 7 to 10 carbon atoms (such as a benzyl group, a phenethyl group, etc.); and a represents 0 or 1, preferably 0.

$R_1$ represents a straight, branched or cyclic chain alkyl group having preferably 1 to 12 carbon atoms (such as a methyl group, an ethyl group, a propyl group, an isopropyl group, a butyl group, an isobutyl group, an isoamyl group, a hexyl group, a 2-ethylhexyl group, an octyl group, a lauryl group, a cyclohexyl group, etc.), a monocyclic or bicyclic aryl group having preferably 6 to 12 carbon atoms (such as a phenyl group, a naphthyl group, a biphenyl group, etc.), an aralkyl group having preferably 7 to 10 carbon atoms (such as a benzyl group, a phenethyl group, an α-phenylethyl group, a phenylpropyl group, etc.), or an alkenyl group having preferably 3 to 12 carbon atoms (such as an alkyl group, a butenyl group, a cinnamyl group, etc.); B represents a repeating unit derived from an ethylene-type monomer different than A excluding substantially the component

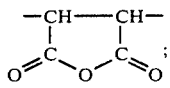

x is about 20 to about 90 mol%; y is about 10 to about 80 mol%; and z is about 0 to about 30 mol%.

The expression represented by the general formula (I) includes random copolymers, alternate copolymers and block copolymers of repeating units A and B.

The term "alkyl group" as used in general formulae (I) and (II) includes both substituted alkyl groups and unsubstituted alkyl groups. Also, the term "aryl group" in general formulae (I) and (II) and the aryl moiety of the aralkyl group in the general formulae include both substituted aryl groups and unsubstituted aryl groups.

Substituents for the alkyl group represented by $R_1$ include a halogen atom (e.g., chlorine, bromine, fluorine, etc.), a cyano group, a tetrahydrofuryl group, a furyl group and an alkoxy group preferably having 1 to 6 carbon atoms (e.g., a methoxy group, an ethoxy group, a butoxy group, a 2-ethoxyethoxy group, etc.). Suitable examples of the substituted alkyl group represented by $R_1$ include a 2-chloroethyl group, a 2,2,3,3-tetrabromopropyl group, a 3-bromopropyl group, a 2-(2-ethoxyethoxy)ethyl group, a 2-cyanoethyl group, a 2-methoxyethyl group, a 2-ethoxyethyl group, a 3-methoxybutyl group, a 2-butoxyethyl group, a tetrahydrofurfuryl group, etc.

Substituents for the aryl group represented by $R_1$ and the aryl moiety of the aralkyl group represented by $R_1$ include a hydroxy group, a halogen atom (e.g., chlorine, bromine, fluorine, etc.), an alkyl group preferably having 1 to 6 carbon atoms (such as a methyl group, an ethyl group, a propyl group, an isopropyl group, a butyl group, a hexyl group, etc.), an alkoxy group preferably having 1 to 6 carbon atoms (such as a methoxy group, an ethoxy group, a propoxy group, a butoxy group, etc.), an alkoxycarbonyl group preferably having 2 to 7 carbon atoms (such as a methoxycarbonyl group, an ethoxycarbonyl group, etc.), a nitro group, and an acyl group (such as an acetyl group, a propanoyl group, a benzoyl group, etc.). Suitable examples of the substituted aryl group represented by $R_1$ include a p-methoxyphenyl group, a 3-methylphenyl group, a 3,5-dimethylphenyl group, a p-tertbutylphenyl group, a p-methoxycarbonylphenyl group, a p-bromophenyl group, etc. Suitable examples of the substituted aralkyl group represented by $R_1$ include a p-chlorobenzyl group, a p-nitrobenzyl group, etc.

Substituents for the aryl group represented by $R_3$ include an acyl group (e.g., an acetyl group, a benzoyl group, etc.), a hydroxy group, a halogen atom (e.g., chlorine, bromine, fluorine, etc.), a straight or branched chain alkyl group preferably having 1 to 4 carbon atoms (such as a methyl group, an ethyl group, an isopropyl group, a butyl group, etc.), an alkoxy group preferably having 1 to 4 carbon atoms (such as a methoxy group, an ethoxy group, a butoxy group, etc.), a haloalkyl group preferably having 1 to 4 carbon atoms (such as a chloromethyl group, a 2-bromoethyl group, etc.), an acyloxy group preferably having 2 to 5 carbon atoms (such as an acetyloxy group, a propanoyloxy group, etc.). Representative examples of the substituted aryl group represented by $R_3$ include a 3-bromophenyl group, a 4-chlorophenyl group, a 4-fluorophenyl group, a 4-methylphenyl group, a 2,4-dimethylphenyl group, a 4-methoxyphenyl group, a 4-propoxyphenyl group, a 4-chloromethylphenyl group, etc.

Substituents for the alkyl group represented by $R_4$ include a halogen atom (e.g., chlorine, bromine, fluorine, etc.) and an alkoxy group preferably having 1 to 6 carbon atoms (e.g., a methoxy group, an ethoxy group, a butoxy group, a 2-ethoxyethoxy group, etc.). Representative examples of the substituted alkyl group represented by $R_4$ include a 2-chloroethyl group, a methoxyethyl group, an ethoxymethyl group, etc.

Substituents for the alkyl group represented by $R_5$ include a halogen atom (e.g., chlorine, bromine, fluorine, etc.), a tetrahydrofurfuryl group and a furyl group. Representative examples of the substituted alkyl group represented by $R_5$ include a chloromethyl group, a dichloromethyl group, etc.

Substituents for the aryl group represented by $R_5$ and for the aryl moiety of the aralkyl group represented by $R_5$ include a halogen atom (e.g., chlorine, bromine, fluorine, etc.), a straight or branched chain alkyl group preferably having 1 to 4 carbon atoms (e.g., a methyl group, an ethyl group, an isopropyl group, a butyl group, etc.), and an alkoxy group preferably having 1 to 4 carbon atoms (e.g., a methoxy group, an ethoxy group, an isopropoxy group, a butoxy group, etc.). Representative examples of the subtituted aryl group represented by $R_5$ include a 4-chlorophenyl group, a 4-methoxyphenyl group, a 2,4 -dimethylphenyl group, etc. Representative examples of the substituted aralkyl group represented by $R_5$ include a p-chlorobenzyl group, etc.

Substituents for the alkyl group represented by $R_6$ include a halogen atom (e.g., chlorine, bromine, fluorine, etc.), an acyl group (e.g., an acetyl group, a propanoyl group, a benzoyl group, etc.), a tetrahydrofuryl group, a furyl group, etc. Representative examples of the substituted alkyl group represented by $R_6$ include a chloromethyl group, a dichloromethyl group, etc.

Substituents for the aryl group represented by $R_6$ and substituents for the aryl moiety of the aralkyl group represented by $R_6$ include an acyl group (e.g., an acetyl group, a propanoyl group, a chloroacetyl group, a benzoyl group, etc.), a halogen atom (e.g., chlorine, bromine, fluorine, etc.), a straight or branched chain alkyl group having preferably 1 to 4 carbon atoms (e.g., a methyl group, an ethyl group, an isopropyl group, a butyl group, etc.), and an alkoxy group preferably having 1 to 4 carbon atoms (e.g., a methoxy group, an ethoxy group, a 2-ethoxyethoxy group, a butoxy group, etc.). Representative examples of the substituted aryl group represented by $R_6$ include a 4-chlorophenyl group, a 4-methoxyphenyl group, a 2,4-dimethylphenyl group, etc. Representative examples of the substituted aralkyl group represented by $R_6$ include a p-chlorophenyl group, etc.

Also, the halogen atom represented by $R_2$ and $R_3$ may be chlorine, bromine, or fluorine.

The polymer or copolymer represented by the general formula (I) can be prepared by copolymerizing maleic acid monoester, fumaric acid monoester, and the monomers providing component A and component B respectively or by half-esterifying with an alcohol the polymer obtained by copolymerizing maleic anhydride and the monomers providing repeating units A and B respectively.

In more detail, examples of the monomers providing repeating units A are ethylenically unsaturated monomers including alkenes and haloalkenes, styrenes, vinyl ethers, vinyl esters, allyl compounds, acrylic acid esters, methacrylic acid esters, etc. Examples of alkenes and haloalkenes include ethylene, propylene, butylene, isobutylene, hexene, dodecene, vinyl chloride, vinylidene chloride, etc. Examples of the styrenes include styrene, vinyltoluene, α-methylstyrene, dimethylstyrene, chlorostyrene, bromostyrene, trifluorostyrene, etc. Examples of the vinyl ethers include methyl vinyl ether, ethyl vinyl ether, butyl vinyl ether, chloroethyl vinyl ether, benzyl vinyl ether, etc. Examples of the vinyl esters include vinyl acetate, vinyl propionate, vinyl butyrate, vinyl benzoate, vinyl chloroacetate, vinyl caproate, etc. Examples of the allyl compounds include allyl acetate, allyl caproate, allylbutyl ether, allyloctyl ether, etc. Examples of the acrylic acid esters include methyl acrylate, ethyl acrylate, butyl acrylate, octyl acrylate, phenethyl acrylate, benzyl acrylate, cyclohexyl acrylate, methoxyethyl acrylate, chloroethyl acrylate, etc. Examples of the methacrylic acid esters include methyl methacrylate, ethyl methacrylate, propyl methacrylate, butyl methacrylate, lauryl methacrylate, benzyl methacrylate, cyclohexyl methacrylate, chloroethyl methacrylate, ethoxyethyl methacrylate, etc. Among these monomers, alkenes, styrenes, vinyl ethers, acrylic acid esters, and methacrylic acid esters are preferred and, in particular, styrenes and vinyl ethers are most preferred.

Particularly preferred examples of the compound represented by the formula (I) include those in which A represents:

$$+CH_2-CH_2+,\ +CH_2-CH(C_6H_5)+,\ +CH_2-CH(OCH_3)+ \text{ or } +CH_2-C(CH_3)_2+$$

As practical examples of monomers providing the

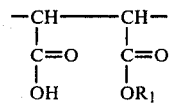

component, there are monomethyl maleate, monoethyl maleate, monobutyl maleate, monooctyl maleate, monododecyl maleate, monomethyl fumarate, monobutyl fumarate, monooctyl fumarate, monobenzyl fumarate, etc. When two or more alcohols are used in preparing the maleic acid monoester, copolymers represented by the formula (I) containing maleic acid monoester units having different groups for $R_1$ (such as Compound 22 described hereinafter) can be obtained. This invention also include this type of compounds within its scope.

As the monomers providing component B, there are, for example, acrylamides, methacrylamides, 5- to 7-membered vinyl heterocyclic compounds containing at least one of oxygen, sulfur and nitrogen as a hetero atom, unsaturated nitriles having 3 to 6 carbon atoms, itaconic acid and its derivatives, maleic acid diesters, fumaric acid diesters having 1 to 12 carbon atoms in each alcohol moiety, crotonic acid and its derivatives, vinylketones, etc. More particularly, examples of the acrylamides include acrylamide, methylacrylamide, butylacrylamide, diethylacrylamide, N-(1,1-dimethyl-3-oxobutyl)acrylamide, acryloylmorpholine, etc. Examples of the methacrylamides include methacrylamide, methylmethacrylamide, tert-butylmethacrylamide, phenylmethacrylamide, dimethylmethacrylamide, methacryloylmorpholine, methacryloylpiperidine, etc. Examples of the vinyl heterocyclic compounds include N-vinylpyrrolidone, N-vinyloxazolidone, N-vinyltriazole, N-vinylsuccinimide, etc. Examples of the unsaturated nitriles include acrylonitrile, methacrylonitrile, maleonitrile, etc. Examples of the itaconic acids include itaconic anhydride, itaconic acid, monoethyl itaconate, dimethyl itaconate, etc. Examples of the maleic acid diesters include dimethyl maleate, diethyl maleate, dibutyl maleate, etc. Examples of the fumaric acid diesters include dimethyl mfumarate, diethyl fumarate, dibutyl fumarate, etc. Examples of the crotonic acids include crotonic acid, methyl crotonate, ethyl crotonate, etc. Examples of the vinylketones include methyl vinyl ketone, methyl isopropyl ketone, phenyl vinyl ketone, etc.

Among these compounds for B, acrylamides, methacrylamides, vinyl heterocyclic compounds, unsaturated nitriles, itaconic acid and its derivatives, maleic acid diesters, and fumaric acid diesters are preferred, and acrylamides, vinyl heterocyclic compounds, unsaturated nitriles and maleic diesters are particularly preferred.

In accordance with the present invention, x is about 20 to 90 mol%, preferably about 30 to 70 mol%, y is about 10 to 80 mol%, preferably about 30 to 50 mol%, and z is about 0 to 30 mol%, preferably about 0 to 20 mol%, more preferably about 0 to 15 mol%. When y is below 10 mol% neutralization speed is too low, while when y is above 80 mol% neutralization speed is too high.

There is no particular restriction on the molecular weight of the copolymer used in this invention but from the viewpoint of solubility of the copolymer, its compatibility with acetyl cellulose, and handling of the copolymer, the preferred molecular weight (number average) is about 1,000 to 1,000,000, in particular, about 5,000 to 500,000.

It is convenient to prepare the copolymers of the general formula (I) used in this invention by referring to the methods described in, for example, British Pat. No. 1,211,039, Japanese Patent Publication No. 29,195/72, Japanese Patent Application Nos. 7,174/72 (now Japanese Patent Application (OPI) No. 92,022/73), 23,466/72 (now Japanese Patent Application (OPI) No. 21,134,74, 59,743/72 (now Japanese Patent Application (OPI) No. 120,634,74 and 31,355/73 Japanese Patent Application (OPI) No. 135,619/74 (The term "OPI" as used herein refers to a "published unexamined Japanese patent application"), British Pat. No. 961,395, U.S. Pat. Nos. 3,227,672, 3,290,417, 3,262,919, 3,245,932, 2,681,897 and 3,230,275, John C. Petropoulos et al., *Official Digest,* 33, 719–736 (1961), J. Aoyagi and I. Shinohara, *J. Appl. Polym. Sci.,* 16 (Z), 449–460 (1972), *Encyclopedia of Polymer Science and Technology,* 1, 67–95, C. D. Chow, *J. Appl. Polym. Sci.,* 20, 1619–1626 (1976), C. Caze et al., *J. Macromol. Sci.,* A 9 (1), 29–43 (1975), R. B. Seymour et al., *Polymer,* 17, 21–24 (1976), and *Kobunshi,* 14 (156), 217–223 (1965). It will be understood to persons skilled in the art, as a matter of course, the polymerization initiators, concentrations, polymerization temperatures, reaction time, etc., can be easily and broadly varied depending on the kind of the polymer to be prepared as will be evident from the Synthesis Examples which follow.

In one embodiment of the present invention, polymerization is generally carried out at 20° to 180° C., preferably 40° to 120° C. The polymerization reaction is performed using a free radical polymerization initiator in an amount of about 0.05 to 5% by weight based on the weight of the monomers to be copolymerized. As suitable polymerization initiators, there are azobic compounds, peroxides, hydroperoxides, redox catalysts, etc. More particularly, there are potassium persulfate, tert-butyl peroctoate, benzyl peroxide, isopropylpercarbonate, 2,4-dichlorobenzoyl peroxide, methyl ethyl ketone peroxide, cumene hydroperoxide, dicumyl peroxide, azobisisobutyronitrile, etc.

Typical examples of the copolymers of the general formula (I) used in this invention are illustrated below although the copolymers used in this invention are not limited to these specific examples. Unless otherwise indicated, the ratio of x to y or m to n is by mole.

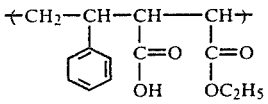
(1)

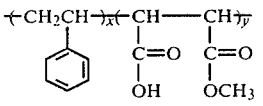
(2)

(x:y = 61:39)

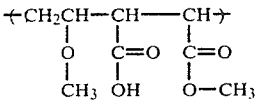
(3)

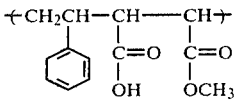
(4)

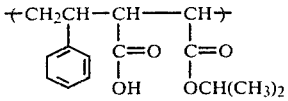
(5)

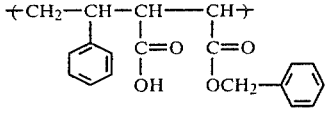
(6)

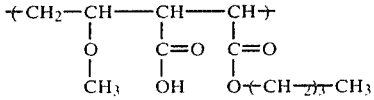
(7)

-continued

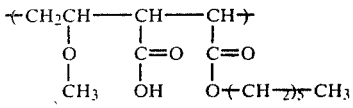
(8)

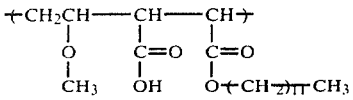
(9)

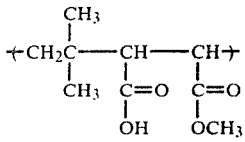
(10)

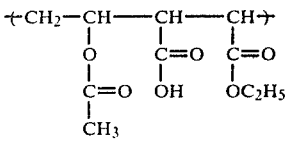
(11)

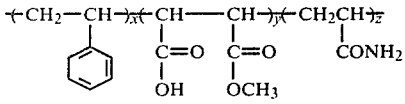
(12)

(x:y:z = 48:46.5:5.5)

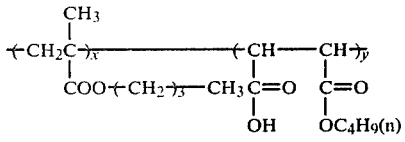
(13)

(x:y = 7:3)

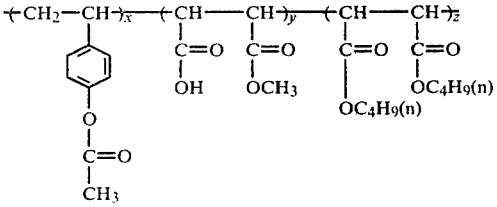
(14)

(x:y:z = 6:3:1)

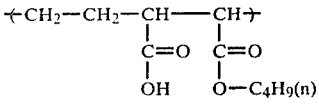
(15)

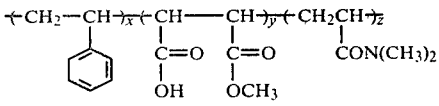
(16)

(x:y:z = 4:4:2)

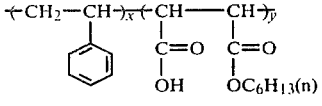
(17)

(x:y = 65:35)

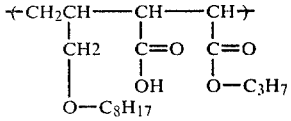
(18)

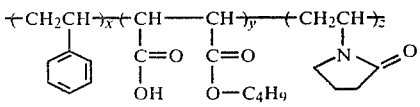
(19)

(x:y:z = 5:3:2)

-continued

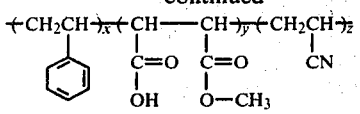

(20)

(x:y:z = 6:3:1)

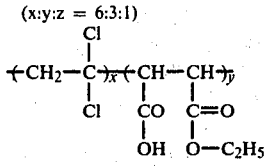

(21)

(x:y = 6:4)

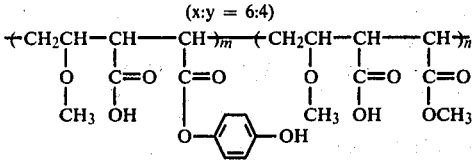

(22)

(m:n = 4:1)

SYNTHESIS EXAMPLE 1

Synthesis of Copolymer (2)

In a three neck 5 liter flask equipped with a stirrer, a thermometer, a nitrogen introducing pipe and a reflux condensor were placed 1,248 g of styrene, 1,040 g of monomethyl maleate, 800 ml of acetone, 800 ml of isopropyl alcohol, and 20 g of benzoyl peroxide to form a solution and after replacing the air in the flask with nitrogen gas, the temperature was raised to cause refluxing. The solution was refluxed for 4 hours with stirring and a solution of 5 g of benzoyl peroxide in a mixture of 270 ml of acetone and 270 ml of isopropyl alcohol was added to the solution followed by stirring for 2 hours at 60° C. After adding thereto 1 liter of methanol to dissolve the product sticking to the flask, the temperature of the solution was reduced. While stirring the reaction mixture vigorously by means of the stirrer, ethanol in ten times excess was added to the reaction mixture and the precipitates formed were washed well, recovered by filtration, and dried by means of a vacuum dryer to provide 2,150 g of the product. The $\eta_{sp}/C$ of the product measured in acetone at 30° C. was 0.16. The component ratio of monomethyl maleate in the product measured by potentiometry was 39 mol%.

SYNTHESIS EXAMPLE 2

Synthesis of Copolymer (3):

A 50 ml three neck flask equipped with a thermometer, a stirrer, and a reflux condensor was placed on a steam bath. To the flask were added 50 g of a methyl vinyl ether-maleic anhydride alternate copolymer and 300 ml of methanol and after raising the temperature of the steam bath to 70° C. and stirring the mixture for 15 hours while refluxing methanol, the temperature was lowered. The reaction mixture obtained was poured into 2 liters of ether while stirring and the polymer precipitate was collected and dried by means of a vacuum dryer. The amount of the product obtained was 58 g and the $\eta_{sp}/C$ of it measured in acetone at 30° C. was 0.62.

SYNTHESIS EXAMPLE 3

Synthesis of Copolymer (12)

In a 2 liter three neck flask equipped with a stirrer, a thermometer, a nitrogen introducing conduit, and a reflux condenser were placed 312 g of styrene, 390 g of monomethyl maleate, 28.4 g of acrylamide, 260 ml of isopropyl alcohol, 260 ml of acetone, and 7 g of benzoyl peroxide to form a solution. After replacing the air in the flask with nitrogen gas, the solution was heated to 75° C. and stirred, whereby the polymerization reaction was started and the temperature of the system increased temporarily to about 85° C. by exothermic reaction. Thereafter, the mixture was stirred for 5 hours at 75° C. and then a solution of 3 g of benzoyl peroxide in 70 ml of isopropyl alcohol and 70 ml of acetone was added to the mixture. After further stirring the resultant mixture for 3 hours at 70° C., 500 ml of methanol was added thereto and the temperature was lowered. The reaction mixture obtained was poured into about 10 liters of ether while stirring vigorously by means of an agitator and the polymer precipitate was adequately washed, collected by filtration, and dried in a vacuum. The amount of the product obtained was 665 g, the acrylamide content thereof by elementary analysis was 5.5 mol%, the monomethyl maleate content by potentiometric titration was 46.5 mol%, and the $\eta_{sp}/C$ measured in acetone at 30° C. was 0.18.

SYNTHESIS EXAMPLE 4

Synthesis of Copolymer (5)

In the same apparatus as used in Synthesis Example 2 were charged 50 g of a styrene-maleic anhydride alternate copolymer, 200 ml of methyl ethyl ketone, and 150 ml of isopropyl alcohol. Then, after adding thereto 3 ml of 85% phosphoric acid, the temperature of the mixture was raised and the mixture was stirred for 20 hours while refluxing. The polymer thus precipitated was purified and dried as in Synthesis Example 2. The amount of the product was 62 g and the $\eta_{sp}/C$ of it in acetone at 30° C. was 0.71.

In the same manner as in Synthesis Example 4, copolymers 7, 8 and 9 were easily prepared using a methyl vinyl ether-maleic anhydride alternate copolymer in place of the styrene-maleic anhydride alternate copolymer in Synthesis Example 4 and using butanol, n-hexyl alcohol, and lauryl alcohol respectively in place of isopropyl alcohol.

The optimum mixing ratio of the copolymer of the formula (I) and acetyl cellulose used in the neutralizing system of this invention is difficult to define generally since it depends upon a number of factors including the degree of acetylation of the acetyl cellulose used but the proportion of the copolymer is usually about 1 to 20% by weight, preferably about 5 to 15% by weight, to the acetyl cellulose. Generally, the degree of acetylation of the acetyl cellulose is about 45 to 60% (meaning that 45 to 60 g of acetic acid is formed upon hydrolysis of 100 g of acetyl cellulose), and preferably about 50 to 55%.

The timing layer used in this invention can be formed by coating directly or indirectly on a neutralizing layer a solution of a mixture of acetyl cellulose and the copolymer of this invention in an organic solvent such as acetone, cyclohexane, etc., or a mixture thereof. By the term "indirectly" is meant that the coating composition is coated on the neutralizing layer through other timing layers or a layer for improving adhesion, e.g., a subbing layer.

The coating amount for the polymer composition of the timing layer is usually about 1 to about 10 g/m$^2$, preferably 2 to 6 g/m$^2$. However, the coating amount is not limited to the above range since the optimal value will vary depending upon the composition of the copolymers, the mixing ratio of the copolymer and acetyl cellulose.

It is preferred that a film-forming acid polymer be used as the neutralizing layer and suitable acid polymers used for this purpose are well known in the art. Examples of the acid polymers used in this invention are a monobutyl ester of a copolymer of maleic anhydride and ethylene, a monobutyl ester of a copolymer of methyl vinyl ether and maleic anhydride, a monoethyl ester of a copolymer of maleic anhydride and ethylene, a monopropyl ester of the above-described copolymers, a monopentyl ester of the above-described copolymers, a monohexyl ester of the above-described copolymers, a monoethyl ester of a copolymer of maleic anhydride and methyl vinyl ether, a monopropyl ester of the aforesaid copolymer, a monobenzyl ester of the aforesaid copolymer, a monohexyl ester of the aforesaid copolymer, polyacrylic acid, polymethacrylic acid, copolymers of acrylic acid and methacrylic acid in various ratios, and copolymers of acrylic acid or methacrylic acid and a vinylic monomer (e.g., acrylic acid esters, methacrylic acid esters, vinyl ethers, acrylamides, methacrylamides, etc.) in various ratios (preferably the content of acrylic acid or methacrylic acid is about 50 to 90 mol%).

Various neutralizing layers are disclosed in U.S. Pat. Nos. 3,362,819, 3,765,885, 3,819,371 and French Patent No. 2,290,699. Among the acid polymers illustrated above and disclosed in the above-described patents, polyacrylic acid and an acrylic acid-butyl acrylate copolymer are preferably used.

Furthermore, the permissible range of processing temperature can be expanded by providing, between the timing layer and the place where alkaline processing composition spreads, a layer comprising a polymer having a permeability to alkaline processing composition which increases as the temperature increases and decreases as the temperature decreases as described in, for example, U.S. Pat. Nos. 4,056,394, 4,061,496, Japanese Patent Application No. 144,749/77 corresponding to Japanese Patent Application (open to public inspection) 78,130/79 and Japanese Patent Application (OPI) No. 72,622/78.

Also, the neutralizing timing layer of this invention may contain a developing inhibitor precursor as described in U.S. Pat. No. 4,009,029.

A silver halide emulsion used in this invention is a dispersion in hydrophilic colloid of silver chloride, silver bromide, silver chlorobromide, silver iodobromide, silver chloroiodobromide or a mixture thereof and the halogen composition is selected according to the use of the photosensitive materials and the processing conditions, but a silver iodobromide emulsion or a silver chloroiodobromide emulsion having an iodide content of 1 to 10 mol% and a chloride content of less than 30 mol% is particularly preferred.

In this invention, silver halide emulsions wherein latent image is likely to form on the surface of the silver halide grains can be used but the internal latent image-type direct reversal silver halide emulsions as described in U.S. Pat. Nos. 2,497,875, 2,588,982, 2,456,953, 3,761,276, 3,206,313, 3,317,322, 3,761,266, 3,850,637, 3,923,513, 3,736,140, 3,761,267 and 3,854,949 are preferably used.

As the dye image-providing materials for color diffusion transfer photographic process used in this invention, there are various compounds such as the dye developers as described in, for example, U.S. Pat. Nos. 2,983,606, 3,230,085, 3,227,551, 3,227,554, 3,443,939, 3,443,940, 3,551,406, 3,658,524, 3,698,897, 3,725,062, 3,728,113, 3,751,406, 3,929,760, 3,931,144 and 3,932,381, British Pat. Nos. 840,731, 904,364, and 1,038,331, West German Patent Application (OLS) Nos. 1,930,215, 2,214,381, 2,228,361, 2,242,762, 2,317,134, 2,402,900, 2,406,626, and 2,406,653, and Japanese Patent Application (OPI) Nos. 114,424/74, 126,332/74, 33,826/73, 126,331/74, 115,528/75, 113,624/76, and 104,343/76. In these dye image-providing materials, it is preferred to use the dye image-providing materials of the type which are initially non-diffusible but after entering an oxidation reduction reaction with the oxidized product of the color developing agent, which split and release a diffusible dye (hereafter, such a dye image-providing compound is referred to as a "DRR compound").

Practical examples of DRR compounds used with this invention are magenta dye image-forming materials such as 1-hydroxy-2-tetramethylenesulfamoyl-4-[3'-methyl-4'-(2''-hydroxy-4''-methyl-5''-hexadecyloxyphenylsulfamoyl)phenylazo]naphthalene, etc., yellow dye image-forming materials such as 1-phenyl-3-cyano-4-{3'-[2''-hydroxy-4''-methyl-5''-(2''',4'''-di-t-pentylphenoxyacetamino)phenylsulfamoyl]phenylazo}-5-pyrazolone, etc., besides those disclosed in the above-described patents or patent applications.

In the case of using DRR compounds in this invention, any silver halide developing agents which can cause cross oxidation can be used. Such developing agents may be incorporated in an alkaline processing composition (processing element) or may be incorporated in a proper layer or layers of the photosensitive element. Examples of the developing agents used in this invention are hydroquinone, aminophenols (e.g., N-methylaminophenol), 1-phenyl-3-pyrazolidone, 1-phenyl-4,4-dimethyl-3-pyrazolidone, 1-phenyl-4-methyl-4-oxymethyl-3-pyrazolidone, N,N-diethyl-p-phenylenediamine, 3-methyl-N,N-diethyl-p-phenylenediamine, 3-methoxy-N-ethoxy-p-phenylenediamine, etc.

Of the developing agents described above, black-and-white developing agents capable of reducing the formation of stain in an image-receiving layer (or mordanting layer) are particularly preferable.

The direct reversal silver halide photographic emulsion which can be used in this invention can provide direct positive images by developing the silver halide photographic emulsion layer in the presence of a fogging agent after image exposure or alternatively by subjecting the silver halide emulsion layer to overall exposure (i.e., subjecting the layer to high illumination exposure for a short period of time less than $10^{-2}$ second, or subjecting the layer to low illumination exposure for a short period of time) during surface development after image exposure as described in Knott and Stevens, U.S. Pat. No. 2,456,953. In this case, it is preferred to use a fogging agent since the extent of fogging can be easily controlled. The fogging agent may be incorporated in the photosensitive element or developer. Examples of the fogging agent for a silver halide emulsion of this type are the hydrazines described in U.S. Pat. Nos. 2,588,982 and 2,568,785; the hydrazide and hydrazone described in U.S. Pat. No. 3,227,552; the quaternary salt compounds described in British Pat. No. 1,283,835, Japanese Patent Publication No. 38,164/74, and U.S. Pat. Nos. 3,734,738, 3,719,494 and 3,615,615; and the acylhydrazinophenylthiourea compounds described in West German Patent Application (OLS) No. 2,635,316.

The amount of the fogging agent used can be varied over a wide range according to the result desired. In the case of incorporating the fogging agent in the photosensitive materials, the concentration of the fogging agent generally depends upon the kind of the fogging agent used but is usually about 0.1 to 1,500 mg per mole of silver, preferably about 0.5 to 700 mg per mole of silver.

In the case of incorporating the fogging agent in a developer, the concentration thereof is generally from about 0.05 to 5 g, preferably from about 0.1 to 1 g, per liter of the developer. It can be desirable to render the fogging agent non-diffusible, for example, by bonding a ballast group usually used for couplers to the fogging agent.

Furthermore, transferred positive images can be obtained by a DIR reversal silver halide emulsion system as described in U.S. Pat. Nos. 3,227,551, 3,227,554 and 3,364,022 or a reversal silver halide emulsion system by dissolution physical development as described in British Pat. No. 904,364. In U.S. Pat. Nos. 3,227,550 and 3,227,552 and British Pat. No. 1,330,524 are described a series of processes for obtaining color diffusion transfer images.

Typical examples of the color developing agent when using diffusible dye releasing couplers in this invention are the paraphenylenediamine derivatives as described in U.S. Pat. Nos. 3,227,552, 2,559,643 and 3,813,244. Furthermore, the p-aminophenol derivatives as described in Japanese Patent Application (OPI) No. 26,134/73 can be advantageously used in this invention. It is preferred that such a color developing agent be incorporated in an alkaline processing composition for development contained in a rupturable container. The color developing agent can also be incorporated in a photographic layer which is formed separately from silver halide emulsion layers in the photosensitive element, or it may be incorporated in the silver halide emulsion layers.

The photographic element for the diffusion transfer color photographic process of this invention includes a support which is not subject to large dimensional deformation during processing. Examples of such a support are cellulose acetate films, polystyrene films, polyethylene terephthalate films, polycarbonate films, etc., used for ordinary photographic photosensitive materials. Other effective examples of the support are papers and papers coated with a polymer which is water impermeable, such as polyethylene.

The processing composition used in this invention is a liquid composition containing a developing agent for silver halide emulsions and processing components necessary for forming diffusion transfer dye images and the main solvent therefor is water but the liquid composition may further contain another hydrophilic solvent such as methanol, methyl Cellosolve, etc. The processing composition also contains an alkali in an amount sufficient to maintain the necessary pH for development of silver halide emulsion layers and sufficient for neutralizing the acid (e.g., a hydrohalogenic acid such as hydrobromic acid, etc., or a carboxylic acid such as acetic acid, etc.) formed during development and other various steps for dye image formation.

Examples of the alkali used are alkali metal salts or alkaline earth metal salts, or amines such as lithium hydroxide, sodium hydroxide, potassium hydroxide, a dispersion of calcium hydroxide, tetramethylammonium hydroxide, sodium carbonate, trisodium phosphate, diethylamines, etc., but it is preferred that an alkali hydroxide be incorporated in the processing composition at a concentration giving a pH of higher than about 12, preferably higher than about 14 at room temperature.

More preferably, the processing composition contains a hydrophilic polymer such as high molecular weight polyvinyl alcohol, hydroxyethyl cellulose, sodium carboxymethyl cellulose, etc. The addition of such a polymer increases the viscosity of the processing composition to higher than 1 poise, preferably to about 500 to 1,000 poise at room temperature to not only facilitate the uniform spreading of the processing composition upon processing but also to form a non-flowable film when the processing composition is concentrated by the transfer of the aqueous solvent into the photosensitive element and image-receiving element during the step of processing, which results in assisting the photographic elements for diffusion transfer color photographic process becoming unified after processing. The polymer film also contributes to prevent the dye images formed from being changed by further suppressing the transfer of coloring components into the image-receiving element after the formation of the diffusion transfer dye images has been substantially finished.

It is, as the case may be, advantageous that the processing composition further contains a light absorbing material such as $TiO_2$, carbon black, a pH indicating dye, etc., or desensitizers as described in U.S. Pat. No. 3,579,333 for preventing the silver halide emulsion layers from being fogged by external light during processing. Furthermore, the processing composition can contain a development inhibitor such as benzotriazole.

It is preferred that the aforementioned processing composition be used in a rupturable container as described in U.S. Pat. Nos. 2,543,181, 2,643,886, 2,653,732, 2,723,051, 3,056,491, 3,056,492 and 3,152,515.

As the mordant used in the image-receiving layer of the image-receiving element in this invention, there is the poly-4-vinylpyridine latex (in, particularly, polyvinyl alcohol) as described in U.S. Pat. No. 3,148,061; polyvinylpyrrolidone as described in U.S. Pat. No. 3,003,872; the polymer mordants containing quaternary ammonium salts or phosphonium salts as described in U.S. Pat. Nos. 3,547,649, 3,709,690, 3,770,439, and 3,898,088; the coacervate mordants as described in U.S. Pat. No. 3,271,147; and the latex mordants as described in U.S. Pat. No. 3,958,995.

The copolymer of this invention used together with acetyl cellulose is preferably used for the neutralization timing layer of the photographic film unit having the following structural elements and more particularly a film unit which can be processed by being passed between a pair of juxtaposed pressing means;

(a) at least one photosensitive silver halide emulsion layer (a photosensitve element) associated with a dye image-providing material formed on a support, (b) an image-receiving layer (image-receiving element), (c) an alkaline processing composition preferably contained in a rupturable container in the film unit (It is preferred that the processing composition contains silver halide developing agent.), (d) a neutralizing layer for neutralizing the alkaline processing composition, and (e) a neutralizing timing layer for controlling the neutralization rate of said neutralizing layer.

The aforementioned photosensitive element in the film unit is superimposed on the image-receiving element having combined therewith the neutralizing layer of this invention in face-to-face relation after image exposure and is processed by spreading the alkaline processing composition therebetween. In this case, a system wherein the image-receiving element is separated after transfer of the dye images may be employed or a system wherein dye images transferred to the image-receiving element can be observed without separation of the image-receiving element as described in U.S. Pat. No. 3,415,645.

In another practical example, the image-receiving layer in the aforementioned film unit can be disposed in a unitary structure with the photosensitive element together with a support. For example, a film unit comprising a support having coated thereon an image-receiving layer, a substantially opaque light-reflecting layer (e.g., $TiO_2$-containing layer and a carbon black-containing layer), and a photosensitive element composed of the aforementioned one or more photosensitive silver halide emulsion layers as disclosed in Belgian Patent No. 757,960 is effectively employed in this invention. After imagewise exposing the photosensitive element, the element is superposed on an opaque cover sheet including the neutralizing system of this invention in face-to-face relationship and a processing composition is spread therebetween.

Another mode of the film unit which also has a unitary construction and to which the present invention can be applied is disclosed in Belgian Patent No. 757,959. In this embodiment, an image-receiving element and a substantially opaque light-reflecting layer (e.g., $TiO_2$-containing layer and carbon black-containing layer as described above), and a photosensitive element composed of one or more photosensitive silver halide emulsion layers are coated on a transparent support and further on a transparent cover sheet containing the neutralizing system of this invention is superposed on the photosensitive element in face-to-face relationship. A rupturable container containing an alkaline processing composition containing an opacifying agent (e.g., carbon black) is disposed adjacent to the uppermost (protective) layer of the aforementioned photosensitive element and the transparent cover sheet. Such a film unit is imagewise exposed through the transparent cover sheet in the camera and upon taking the film unit from the camera, the rupturable container is ruptured by pressing means to spread the processing composition containing the opacifying agent between the photosensitive element and the cover sheet, whereby the film unit and in particular the photosensitive element is shaded or protected from light exposure and at the same time the development proceeds.

Also, other useful unitary type film units wherein DRR compounds or diffusible dye releasing couplers that can be modified in accordance with this invention are described in, for example, U.S. Pat. Nos. 3,415,644, 3,415,645, 3,415,646, 3,647,487 and 3,635,707 and West German Patent Application (OLS) No. 2,426,980.

COMPARISON EXPERIMENT

After dissolving 1.35 g of acetyl cellulose having an acetylation degree of 52.3% and 0.15 g of the copolymer of this invention shown in Table 1 in a mixture of 138.8 g of acetone and 46.2 g of cyclohexanone, the permeability of the solution was measured by means of a Hitachi 323 type spectrophotometer at 600 nm. The result is shown in the same table.

TABLE 1

| Copolymer | Permeability (%) | Remarks |
|---|---|---|
| Poly(styrene-maleic anhydride) | 20.6 | Comparison |
| Copolymer 7 | 76.5 | Invention |
| Copolymer 8 | 90.3 | Invention |
| Copolymer 9 | 51.7 | Invention |

As shown in the above table, it will be understood that the copolymers used in this invention have higher transparency in comparison to poly(styrene-maleic anhydride) described in U.S. Pat. No. 4,029,849 and also the copolymers of this invention show excellent compatibility with acetyl cellulose.

EXAMPLE 1

Cover Sheet

The cover sheet in this invention was prepared by coating on a transparent polyethylene terephthalate support the following layers:

(1) a neutralizing layer formed by coating a copolymer of acrylic acid and butyl acrylate, 8:2 by mole ratio, having an average molecular weight of about 50,000 at a coverage of 22 g/m$^2$.

(2) a neutralization timing layer formed by coating a mixture of acetyl cellulose having an acetylation degree of 52.3% and the copolymer shown in Table 2 in a weight ratio of 9:1 at a coverage of 6 g/m$^2$.

The cover sheet in this invention provides a coating layer having excellent transparency as compared with a comparison cover sheet using poly(styrene-maleic anhydride).

pH Indicator Coated Film

The pH indicator coated film was prepared by coating on a transparent polyethylene terephthalate support the following layers:

(1) a pH indicator layer containing 0.2 g/m$^2$ of Thymolphthalein and 7 g/m$^2$ of gelatin.

(2) a white reflection layer containing 20 g/m$^2$ of titanium oxide and 2 g/m$^2$ of gelatin.

(3) a pH indicator layer having the same composition as the layer (1) described above.

Processing Solution

The processing composition consisting of the following components:

Carboxymethyl cellulose (Na salt): 40 g
Potassium hydroxide: 42 g
Water: 918 g

The cover sheet prepared as above and a forcibly deteriorated cover sheet which was prepared as above and stored for 3 days under the forcible aging conditions of 50° C. and 80% relative humidity were placed on the aforementioned pH indicator coated film in face-to-face relationship and then the above-described processing solution was spread between them. Then, the density measurement was performed from the side of the pH indicator coated film to measure at 25° C. "the neutralization time", that is the period of time required for reducing by half the reflection density of the high pH blue of Thymolphthalein by neutralization. The test results are shown in Table 2.

TABLE 2

| Copolymer | Neutralization Time Freshness (min) | 3 Days at 50° C., 80% (min) | Change Ratio* | Remarks |
|---|---|---|---|---|
| Poly(styrene-maleic anhydride) | 5.6 | 11.5 | 2.1 | Comparison |
| Copolymer 2 | 6.3 | 10.5 | 1.7 | Invention |
| Copolymer 5 | 6.4 | 12.0 | 1.9 | Invention |
| Copolymer 3 | 5.4 | 7.1 | 1.3 | Invention |
| Copolymer 7 | 6.4 | 11.9 | 1.9 | Invention |

*Change ratio = A/B
A:The neutralization time under the conditions of 50° C., 80%, and 3 days.
B:The neutralization time in the fresh state.

The results shown in Table 2 indicate that the copolymers of this invention render the cover sheets less subject to change in the neutralization time by forcible aging and hence they show better stability in comparison with the cover sheet prepared with the conventional copolymer.

EXAMPLE 2

Photosensitive Sheet

A photosensitive sheet was prepared by coating on a transparent polyethylene terephthalate support the following layers:

(1) a mordanting layer containing 3.0 g/m$^2$ of the polymer having the following formula

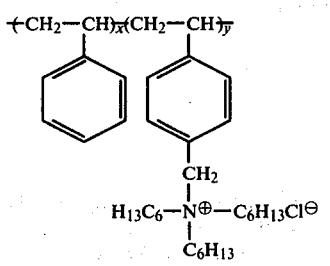

x:y=50:50 and 3.0 g/m$^2$ of gelatin.

(2) a white reflective layer containing 20 g/m$^2$ of titanium oxide and 2.0 g/m$^2$ of gelatin.

(3) a shading layer containing 2.70 g/m$^2$ of carbon black and 2.70 g/m$^2$ of gelatin.

(4) a layer containing 0.50 g/m$^2$ of the cyan dye image-providing material having the following formula dissolved in 0.10 g/m$^2$ of diethyllaurylamide and 0.06 g/m$^2$ of tricresyl phosphate and 1.14 g/m$^2$ of gelatin.

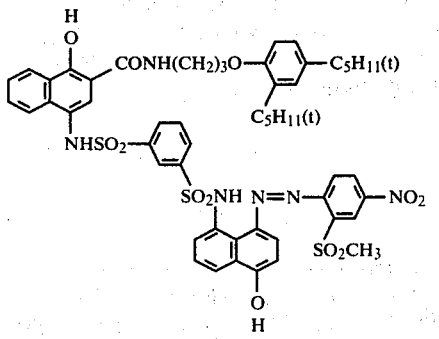

(5) a layer containing a red-sensitive internal latent image type direct reversal silver iodobromide emulsion (at a coverage by silver amount of 2.5 g/m$^2$, the halogen composition in the silver halide: 2 mol% iodine), 2.2 g/m$^2$ of gelatin, 0.20 mg/m$^2$ of the fogging agent having the following formula, and 0.13 g/m$^2$ of sodium pentadecylhydroquinonesulfonate

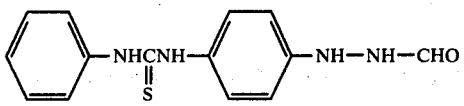

(6) a layer containing 2.6 g/m$^2$ of gelatin and 1.0 g/m$^2$ of 5-dioctylhydroquinone dissolved in 1.6 g/m$^2$ of tricresyl phosphate.

(7) a layer containing 0.0074 g/m$^2$ of 2,5-di-t-butylhydroquinone, 0.76 g/m$^2$ of gelatin, and 0.45 g/m$^2$ of the magenta dye image-providing material having the following formula dissolved in 0.10 g/m$^2$ of diethyllaurylamide

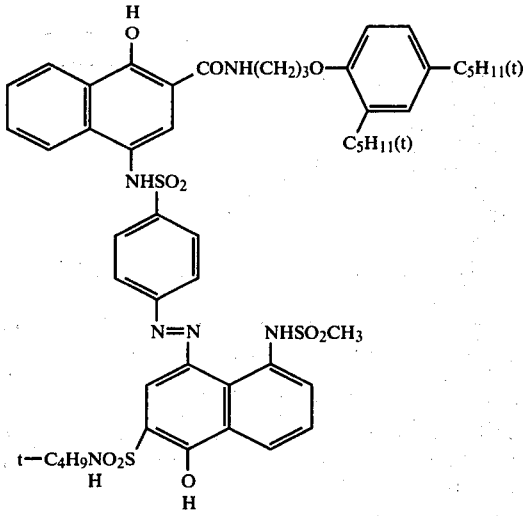

(8) a layer containing a green-sensitive internal latent image type direct reversal silver iodobromide emulsion (at a coverage by silver weight of 2.1 g/m$^2$; the halogen composition of silver iodobromide: 2 mol% iodine), 1.9 g/m$^2$ of galatin, 0.10 mg/m$^2$ of the fogging agent having the same formula as that used in layer (5), and 0.11 g/m$^2$ of sodium pentadecylhydroquinonesulfonate.

(9) a layer containing 2.1 g/m$^2$ of gelatin and 0.85 g/m$^2$ of 2,5-dioctylhydroquinone dissolved in 1.9 g/m$^2$ of tricresyl phosphate.

(10) a layer containing 0.78 g/m$^2$ of gelatin, 0.012 g/m$^2$ of 2,5-di-t-butylhydroquinone, and 0.78 g/m$^2$ of the yellow dye image-providing material having the following formula dissolved in 0.16 g/m$^2$ of diethyllaurylamide

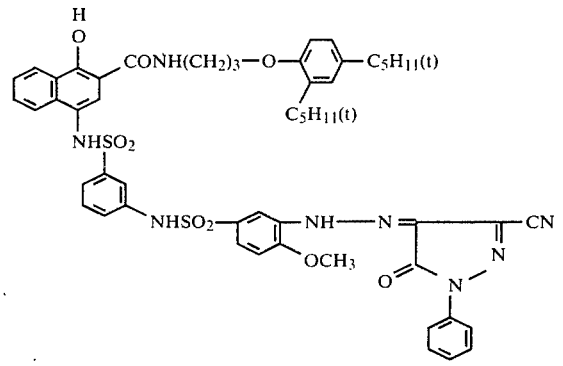

(11) a layer containing a blue-sensitive internal latent image type direct reversal silver iodobromide emulsion (at a coverage by silver weight of 1.7 g/m$^2$; the halogen composition of silver iodobromide: 2 mol% iodine), 1.6 g/m$^2$ of gelatin, 0.09 mg/m$^2$ of the fogging agent having the same formula as that used in layer (5) described above, and 0.094 g/m$^2$ of sodium pentadecylhydroquinonesulfonate.

(12) a layer containing 0.94 g/m$^2$ of gelatin.

| Processing Solution | |
|---|---|
| 1-Phenyl-4-methyl-4-hydroxymethyl-3-pyrazolidinone | 10 g |
| Methylhydroquinone | 0.18 g |
| 5-Methylbenzotriazole | 4.0 g |
| Anhydrous sodium sulfite | 1.0 g |
| Carboxymethylcellulose (Na salt) | 40.0 g |
| Carbon black | 150 g |
| Sodium hydroxide (28% aq. soln.) | 200 ml |
| Water | 550 ml |

A rupturable container was filled with 0.8 g of the processing solution having the above composition.

Cover Sheet

The cover sheet was prepared by coating on a transparent polyethylene terephthalate support the following layers:

(1) a neutralizing layer prepared by coating a copolymer of acrylic acid and butyl acrylate (8:2 by mole ratio) having an average molecular weight of 50,000 at a coverage of 22 g/m$^2$.

(2) a neutralization timing layer formed by coating 6 g/m$^2$ of a mixture of acetyl cellulose having acetylation degree of 52.1 and copolymer 3 described above in a weight ratio of 9:1 and 0.092 g/m$^2$ of 5-(2-cyanoethylthio)-1-phenyltetrazole.

(3) a neutralization timing layer formed by coating 3 g/m$^2$ by solid content of a polymer latex prepared by emulsion-polymerizing styrene, butyl acrylate, and acrylic acid in a weight ratio of 52:42:6.

Processing Step

The aforementioned cover sheet was superposed on the above-described photosensitive sheet and after exposure of the photosensitive sheet from the cover sheet side through a color test chart, the aforementioned processing solution was spread by means of press rollers between the cover sheet and the photosensitive element in such a manner that the thickness of the spread processing solution became 85 microns. The processing was performed at 25° C. and good transferred color images were obtained.

While the invention has been described in detail and with reference to specific embodiments thereof, it will be apparent to one skilled in the art that various changes and modifications can be made therein without departing from the spirit and scope thereof.

What is claimed is:

1. In a photographic element for the color diffusion transfer process comprising a support having a neutralizing system for reducing the pH of an alkaline processing composition, said neutralizing system comprising a neutralizing layer and a timing layer or layers, said timing layer or layers being directly or indirectly disposed on or under said neutralizing layer in such a positional relationship that the aforementioned alkaline processing composition reaches the neutralizing layer through the timing layer or layers, the improvement which comprises: at least one of said timing layers containing a mixture of acetyl cellulose and a polymer represented by the general formula (I):

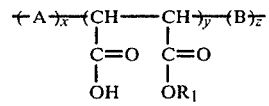

(I)

wherein A represents a repeating unit represented by the formula (II):

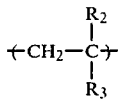

(II)

wherein $R_2$ represents a hydrogen atom, a halogen atom, or a methyl group; $R_3$ represents a hydrogen atom, a halogen atom, an alkyl group, an aryl group, a $-(CH_2)_a-OR_4$ group, a $-(CH_2)_a-O-\underset{\underset{O}{\|}}{C}-R_5$ group, or a $-\underset{\underset{O}{\|}}{C}-O-R_6$ group; $R_4$ represents an alkyl group or an aralkyl group; $R_5$ and $R_6$, which may be the same or different, each represents an alkyl group, an aryl group or an aralkyl group; and a represents 0 or 1; $R_1$ represents an alkyl group, an aryl group or an aralkyl group; B represents a repeating unit derived from an ethylene-type monomer different than A excluding substantially

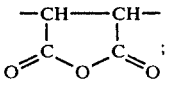

x represents about 20 to 90 mol%; y represents about 10 to 80 mol%; and z represents about 0 to 30 mol%.

2. The photographic element of claim 1, wherein said copolymer of the formula (I) has a molecular weight of about 1,000 to 1,000,000.

3. The photographic element of claim 1, wherein said copolymer of the formula (I) has a molecular weight of about 5,000 to 500,000.

4. The photographic element of claim 1, wherein the amount of said copolymer of the formula (I) is about 1 to 20% by weight to the amount of the acetyl cellulose.

5. The photographic element of claim 1, wherein $R_1$ represents an alkyl group having 1 to 12 carbon atoms, an aryl group having 6 to 12 carbon atoms, or an aralkyl group having 7 to 10 carbon atoms.

6. The photographic element of claim 5, wherein said alkyl group represented by $R_3$ has 1 to 12 carbon atoms, said aryl group represented by $R_3$ has 6 to 12 carbon atoms, said alkyl group represented by $R_4$ has 1 to 12 carbon atoms, said aralkyl group represented by $R_4$ has 7 to 12 carbon atoms, and $R_5$ and $R_6$, which may be the same or different, each represents an alkyl group having 1 to 8 carbon atoms, an aryl group having 6 to 12 carbon atoms, or an aralkyl group having 7 to 10 carbon atoms.

7. The photograhic element of claim 1, wherein $R_1$ represents an alkyl group substituted by a halogen atom, an alkoxy group, a cyano group, a furyl group or a tetrahydrofuryl group.

8. The photographic element of claim 1, wherein $R_1$ represents an aryl group or an aralkyl group substituted by a hydroxy group, a halogen atom, a $C_1$–$C_6$ alkyl group, a $C_1$–$C_6$ alkoxy group, an alkoxycarbonyl group, a nitro group or an acyl group.

9. The photographic element of claim 1, wherein said repeating unit A is $+CH_2\text{-}CH_2+$, $+CH_2\text{-}CH(C_6H_5)+$, $+CH_2\text{-}CH(OCH_3)+$, or $+CH_2\text{-}C(CH_3)_2+$.

10. The photographic element of claim 1, wherein B represents the repeating unit derived from a monomer selected from the group consisting of acrylamides, methacrylamides, vinyl heterocyclic compounds, unsaturated nitriles, itaconic acid and its derivatives, maleic acid diesters, fumraic acid diesters, crotonic acid and its derivatives, and vinyl ketones.

11. The photographic element of claim 1, wherein said acetyl cellulose has an acetylation degree of about 45 to 60%.

12. The photographic element of claim 11, wherein said acetyl cellulose has an acetylation degree of about 50 to 55%.

13. The photographic element of claim 11, wherein the amount of said copolymer of the formula (I) is about 1 to 20% by weight based on the weight of the acetyl cellulose.

14. The photographic element of claim 13, wherein the amount of said copolymer of the formula (I) is about 5 to 15% by weight based on the weight of said acetyl cellulose.

15. The photographic element of claim 1, wherein said element further comprises a photosensitive unit comprising one or more silver halide emulsion layers having associated therewith a dye image providing material.

16. The photographic element of claim 15, wherein said silver halide is an internal latent image-type silver halide.

17. The photographic element of claim 15, wherein said dye image-providing material is a dye releasing redox compound.

18. The photographic element of claim 15, wherein said element additionally comprises an alkaline processing composition contained in a rupturable container.

19. The photographic element of claim 15, wherein said silver halide emulsion layer and associated dye image-providing material constitute a reversal silver halide emulsion system.

20. The photographic element of claim 1, wherein said neutralizing layer is a layer of a film-forming acid polymer.

21. The photographic element of claim 1, wherein said polymer is present in a ratio with respect to said acetyl cellulose in an amount effective to improve storage stability.

* * * * *